United States Patent [19]

Clintberg

[11] Patent Number: 4,919,202

[45] Date of Patent: Apr. 24, 1990

[54] SUCKER ROD GUIDE BEARING

[76] Inventor: Carl Clintberg, 908 - 120 Avenue SE, Calgary, Alberta, Canada, T2J 2K7

[21] Appl. No.: 307,478

[22] Filed: Feb. 8, 1989

[51] Int. Cl.[5] ..... E21B 17/10

[52] U.S. Cl. ..... 166/176; 166/241

[58] Field of Search ..... 175/323, 325; 166/173, 166/176, 241, 242

[56] References Cited

U.S. PATENT DOCUMENTS

| | | | |
|---|---|---|---|
| 2,307,688 | 1/1943 | Larson | 166/176 |
| 4,549,613 | 10/1985 | Case | 166/241 X |
| 4,757,861 | 7/1988 | Klyne | 166/241 |
| 4,809,777 | 3/1989 | Sable | 166/241 |

*Primary Examiner*—William P. Neuder

*Attorney, Agent, or Firm*—Shlesinger & Myers

[57] ABSTRACT

A sucker rod guide bearing attachable at each end to a sucker rod coupling for interconnecting sucker rod sections and centering the sucker rods with respect to a well casing, the bearing includes a cylindrical body with a threaded stud at each end for connection to corresponding sucker rod couplings. A vaned cylindrical wheel is slidably mountable over the body and has a length slightly less than that of the body so as to remain free wheeling. The bearing end surfaces formed between each of the studs in the cylindrical surface of the body for pressing torque transfer engagement with a sucker rod coupling end surface.

5 Claims, 2 Drawing Sheets

SUCKER ROD GUIDE BEARING

BACKGROUND OF THE INVENTION

The present invention relates to a combination coupling and guide bearing for coupling together sections of sucker rods inserted into a deep well as well as to space these rods from the sides of the well.

In establishing wells for production of fluid hydrocarbon, a hole is first drilled into the ground and then logging equipment lowered into the hole and used to determine the character of the formation as a function of depth. A steel pipe or tubing, commonly referred to as casing, is then set in the bore hole down to the bottom. The casing is perforated at selected locations to allow the fluid in the formation to enter the bore hole.

In cases where the fluid is of high viscosity or where there is a relatively low pressure, it is necessary to pump the fluid out of the well. Approximately 90% of all artificial lift wells in the U.S. and Canada consist of a down hole pump connected to a surface power source by a string of sucker rods. Each sucker rod is typically 25 feet long with a diameter of $\frac{3}{4}''$ or $\frac{7}{8}''$ and is provided with a threaded pin end and shoulder at each of its ends. A cylindrical internally threaded member, typically 4" long and $1\frac{5}{8}$ inches diameter is used to couple two sucker rods together. In this way a sucker rod string is made up of a number of rods and couplings with the couplings being larger in diameter than the rods.

A sucker rod string passes through a concentric tubing string consisting of 30 foot sections of tubing having an inside diameter of $2\frac{1}{2}$ inches. Rotation or up and down reciprocating motion of the sucker rods activate the pumps depending on the type of pump employed. In rotary systems, the pump used is often a positive cavity displacement pump which consists of two mating pieces, one being stationary and the other rotating so as to create a chain of cavities moving from the bottom of the assembly to the top. Such systems have the capability to remove troublesome sand and other solids from the bore hole as well as being able to achieve high lifts at slow rotation speeds. Typical rotation speeds encountered are in the area of 600 revolutions per minute at depths of up to 4,000 feet.

Various types of couplings between sections of sucker rods are employed to centralize the sucker rod string. One common type of coupling has an exterior hard surface that turns with the rod and tends to wear out the casing. An elastomeric material is sometimes bonded to the outer surface of the coupling to reduce the wear of the casing which is more expensive and difficult to replace than is the coupling. Couplings having an elastomeric outer surface provide only a partial solution to wearing through of the casing in as much as the elastomeric surface wears away quickly and then the coupling must be replaced or be resurfaced.

U.S. Pat. No. 4,757,861 issued to Klyne discloses a sucker rod coupling assembly having a free turning vaned wheel of soft resilient material, a steel shaft with soft resilient sleeve bonded thereto and coupling end faces wtih soft resilient rings bonded to the ends thereof. The sleeve and rings prevent sand from reaching and abrading the steel surfaces of the shaft and coupling end faces. However, given that the sleeve and rings are soft and resilient, the torque transfer takes place across the stud threads rather than across the rings and sleeve to the steel shaft. Moreover, excessive wear or breaking of the wheel places the steel box end couplings in contact with the well casing or tubing resulting in wearing of the latter rather than the couplings.

A second type of coupling has a free turning vaned wheel made of an elastomer or plastic such as nylon. The wheel is designed to remain stationary and hence avoid wearing of the casing. The wheel acts as a sacrificial surface. Wearing away of the wheel moreover, simply requires replacement with a new wheel and not replacement of the entire coupling, provided that excessive wear or failure of the wheel has not occurred. Existing designs, however, because of restrictions in diameter set by the wheel, exhibit a susceptibility to breakage.

Accordingly, it is an object of the present invention to provide an improved sucker rod guide bearing.

It is a further object of the invention to provide a sucker rod guide bearing employing a free turning vaned wheel and which is capable of withstanding higher torque then other known guide bearings employing such wheels.

It is yet a further object of the invention to provide a sucker rod guide bearing with alternative sacrificial wear surfaces in the event of successive wear or failure of the free turning wheel which acts as the primary sacrificial surface.

SUMMARY OF THE INVENTION

In accordance with the present invention there is provided a sucker rod guide bearing attachable at each end by means of a sucker rod coupling to an adjacent section of a sucker rod. The bearing includes a connecting shaft having a threaded stud at each end and an intermediate cylindrical body of diameter greater than that of the threaded studs. A vaned cylindrical wheel is slidably mountable over the body and has a length slightly less than that of the body. A bearing end surface is formed at either end of the cylindrical body for pressing torque transfer engagement with a sucker rod coupling end surface. Wear means are provided to act as a sacrificial wear surface in the event said wheel is excessively worn or broken the wear means includes a pair of torque transfer washers each positionable between a corresponding bearing end surface and an associated sucker coupling end surface. The washers have a diameter greater than that of the body but less than that of the wheel and are of a material hardness less than that of the well casing material so as to enable the washers to act as alternative sacrificial elements. Thus, the torque transfer washers function both to facilitate pressing engagement of the sucker rod couplings against the bearing end surfaces without contacting the vaned wheel, as well as to be available as an alternative sacrificial element in the event the vaned wheel wears excessively or fails.

Location of the threaded studs away from the interior of the wheel allows them to have a sufficiently large diameter so as to be able to withstand relatively large torque loads. Utilizing a pair of bearing end surfaces permits torque transfer from a sucker rod coupling on one side to the connecting shaft and through to a sucker rod couPling on the opposite side. The cylindrical wheel being free wheeling remains stationary while the rest of the sucker rod assembly rotates.

In another aspect of the invention wear means may be belled ends of the the sucker rod couplings themselves and the belled ends brought into abutment with the corresponding ends of the cylindrical body upon threaded engagement with associated studs at the ends of the bearing. With the diameter of the belled portions being larger than that of the cylindrical body but smaller than that of the vaned wheel, the material of the coupling itself then becomes available as the alternate sacrificial element.

Advantageously the washers may include a cylindrical portion conforming to a curved cylindrical end surface of an associated sucker rod coupling so as to center the washers relative to the axis of the coupling upon pressing engagement of the sucker rod coupling against the washers.

Alternatively the coupling may include a shoulder formed at each end thereof of a diameter greater than that of the threaded studs but less than that of the cylindrical body such that the washers slide snugly over respective ones of the shoulders.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
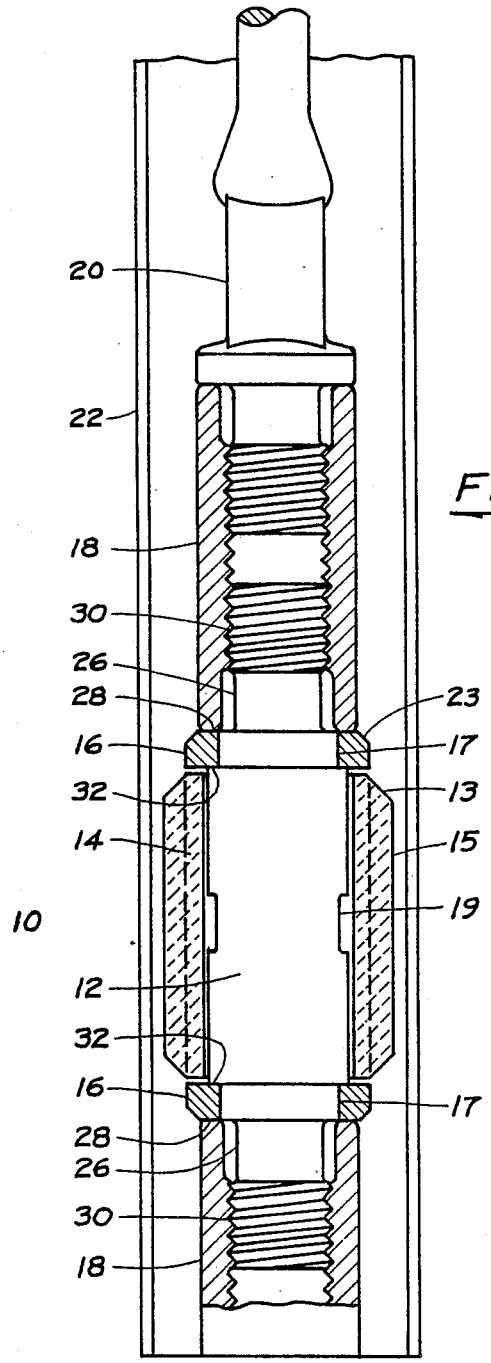
FIG. 1 is a sectional view of a portion of a sucker rod string and well casing showing the preferred body of the sucker rod guide bearing.

In the following description like reference numbers in the different figures refer to like parts. Referring to FIG. 1 there is shown a portion of well tubing including a section of a sucker rod string contained therein. The series of sucker rods 20 are interconnected by means of a sucker rod guide bearing 10 coupled at each end by a standard sucker rod coupling 18.

The bearing 10 consists of a central cylindrical body 12 having shoulders 17 of reduced diameter at either end with the region at the ends of the cylindrical body surrounding the shoulders 17 forming bearing surfaces 32. A shank 26 couples a threaded stud 30 to each end of the body 12 and is of a diameter less than both that of the threaded stud 30 and shoulder 17. The vaned wheel 14 made of elastomeric material is fitted slidably over the cylindrical body 12 and extends longitudinally a length slightly less than that of the body 12. Edges of the wheel 14 are chamfered as at 13 to facilitate insertion and extraction of the sucker rod string. The circular washer 16 chamfered around an outer edge 23 fits snugly over the shoulder 17 abutting end surface 32. Central cylindrical body 12 is provided with wrench flats 19 to facilitate removal from couplings 18.

Upon tightening of the standard coupling 18 over the threaded stud 30, an end of the coupling abuts the washer 16 compressing it against surface 32. By undercutting the shank 26 to be of a diameter less than that of the threaded stud 30, no binding takes place between the latter and the end of coupling 18. By using a relatively incompressible material for the washer 16, prestressing of the threads of stud 30 and those of coupling 18 occurs so that any further cyclical loading does not significantly increase the loading on the studs 30. Torque is then transferred from coupling 18 to washer 16 to connecting cylindrical bodY Portion 12 and out along the equivalent path on the other side through washer 16 and coupling 18.

Figure 2:
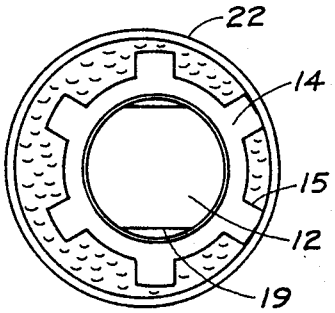
FIG. 2 is a sectional view taken through the bearing wheel and casing showing the positioning of the coupling effected by the bearing wheel against the casing.

The vaned rotatable elastomeric wheel 14 is shown in cross-section in FIG. 2. It will be seen that the vanes serve to space the coupling away from the sides of the well casing 22 and at the same time permit through-flow of fluid in between the vanes 15.

In operation, as the sucker rod string 20 is caused to rotate from a power source located at the surface of the bore-hole (not shown), the vaned wheel 14 rotates only slowly or not at all. Consequently, very little wearing takes place from contact between the vaned wheel 14 and the well casing 22. Moreover, fluid which is pumped from the bottom of the well may pass relatively unimpeded between the vanes of the vaned wheel 14 and the sides of the casing 22.

In the event that the vanes 15 of the vaned wheel 14 wear down significantly, the outer cylindrical surface of washers 16, which are preferably made of mild steel, act as alternative sacrificial surfaces to prevent the coupling or sucker rods themselves from contacting the well casing 22. Ordinarily the casing 22 is made of a material much harder than ordinary mild steel. With the present design the thread size of studs 30 can be made identical to the thread size of a standard sucker rod coupling 18, thereby avoiding the requirement for a special sucker rod coupling 18 to accommodate the bearing 10.

Figure 3:
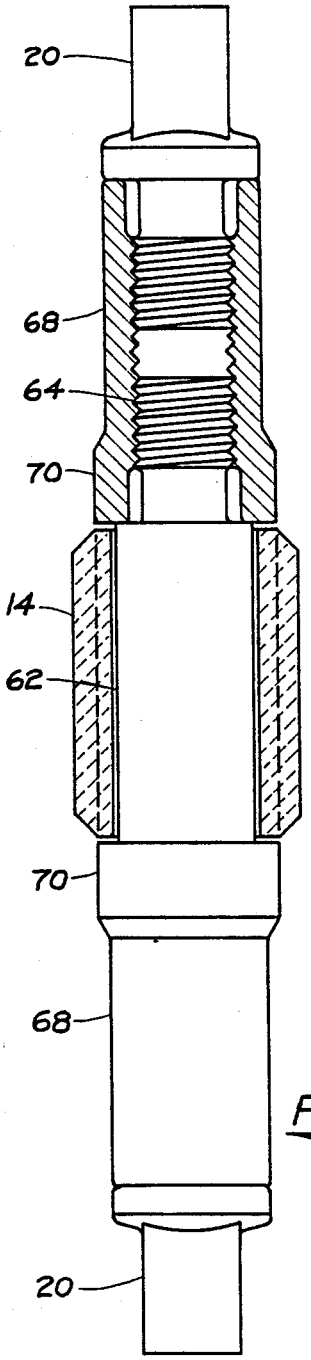
FIG. 3 is a partial sectional view of a bearing with belled sucker rod couplings.

An alternative embodiment of the invention as illustrated in FIG. 3 consists of a connecting shaft having a cylindrical body portion 62 terminating at either end by a threaded stud 64. The body portion 62 accommodates a slidably inserted vaned wheel 14 similar to that as shown in FIGS. 1 and 2. The sucker rod coupling 68, however, is modified to have a belled end 70 which abuts a corresponding end of the body portion 62 when threaded to the threads of stud 64. By forming the belled end 70, not only is there sufficient area for contacting the end edges of body portion 62 but there is also a sufficient surface to act as an alternate sacrificial element in the event vaned wheel 14 is either excessively worn or broken.

Figure 4:
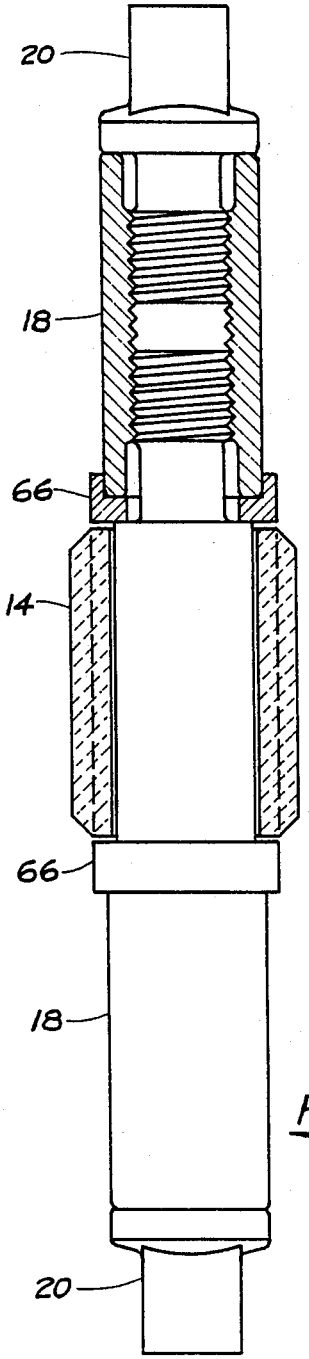
FIG. 4 is a partial sectional view of a bearing with cupped torque transfer washers.

An other alternative embodiment of the invention referring to FIG. 4 consists of a washer 66 which is cupped so as to provide a larger surface in contact with the well casing (not shown) in the event of excessive wear or breakage of wheel 14. The cupped shape also assists in centering the washer relative to the coupling 18 and, therefore, the bearing 10. Such a configuration provides a greater wear surface and hence a longer survival time in the event of wheel failure.

Accordingly, while this invention has been described with reference to illustrative embodiments, this description is not intended to be construed in a limiting sense. Various modifications of the illustrative embodiments, as well as other embodiments of the invention will be apparent to persons skilled in the art upon reference to this description. It is therefore contemplated that the appended claims will cover any such modifications or embodiments as fall within the true scope of the invention.

I claim:

1. A sucker rod guide bearing, attachable at each end by means of a sucker rod coupling to an adjacent section of a sucker rod comprising:

(a) a cylindrical body shaft having a threaded stud at each end and an intermediate cylindrical body of a diameter greater than that of said threaded studs wherein a bearing end surface is formed between each of said studs and the cylindrical surface of said body to provide a friction surface for torque transfer engagement with a sucker rod coupling end surface;

(b) a vaned cylindrical wheel slidably mountable over said body and having a length slightly less than that of said body; and (c) wear means for acting as a sacrificial wear surface in the event said wheel is excessively worn or broken including a pair of torque transfer washers, each positionable between one of said bearing end surfaces and a corresponding sucker rod coupling end surface and having a diameter greater than that of said body but less than that of said wheel wherein the material hardness of said washers is less than that of the wall casing material so as to enable said washers to act as alternative sacrificial elements.

2. A bearing according to claim 1, including a pair of sucker rod couplings for coupling each end of said bearing to corresponding sucker rod sections, wherein said wear means is a belled end having a threaded hole, said belled end for abutment against corresponding ends of said cylindrical body upon threaded engagement of the threaded hole with the corresponding threaded stud of said bearing, the diameter of said belled end being larger than that of said cylindrical body but smaller than that of said vaned wheel and the material of said couplings being softer than that of the well casing.

3. A bearing according to claim 1, including means for centering said washers relative to an axis of said bearing.

4. A bearing according to claim 3, wherein said centering means includes a shoulder formed at each end of the body of diameter greater than that of the threaded studs but smaller than that of the cylindrical body such that said washers slide snugly over respective ones of said shoulders.

5. A bearing according to claim 3, wherein each washer includes a cylindrical portion conformed to a curved cylindrical end surface of an associated sucker rod coupling so that said washers are centered relative to an axis of said coupling by associated ends of sucker rod couplings.

* * * * *